US008403236B2

(12) United States Patent
Hughes et al.

(10) Patent No.: US 8,403,236 B2
(45) Date of Patent: Mar. 26, 2013

(54) NOZZLE FOR USE WITH A TOTE

(75) Inventors: Randall L. Hughes, Glendale, AZ (US); Andrew B. Titus, Mesa, AZ (US); Danny P. Boyle, Gilbert, AZ (US); Michael Mowen, Gilbert, AZ (US)

(73) Assignee: MicroBlend Technologies, Inc., Gilbert, AZ (US)

( * ) Notice: Subject to any disclaimer, the term of this patent is extended or adjusted under 35 U.S.C. 154(b) by 749 days.

(21) Appl. No.: 11/945,886

(22) Filed: Nov. 27, 2007

(65) Prior Publication Data

US 2009/0134234 A1 May 28, 2009

(51) Int. Cl.
*A62C 5/02* (2006.01)

(52) U.S. Cl. ..... 239/8; 239/590; 239/575; 239/462; 239/397; 239/442; 141/387; 141/389; 141/392; 222/189.1; 222/189.11; 222/105; 210/464; 210/462; 210/466; 134/111

(58) Field of Classification Search ..... 239/590, 239/127, 575, 462, 8, 9, 10, 11, 442, 397; 222/92, 100, 105, 106, 107, 173, 189.06, 222/189.1, 189.11, 189.08, 498, 499, 510–526, 222/566, 567, 573, 382, 464.1, 464.2; 210/767, 210/85, 244, 459, 460, 461, 462, 463, 464, 210/465, 466, 467, 468, 482; 134/111; 285/246, 285/247; 141/387, 388, 389, 392
See application file for complete search history.

(56) References Cited

U.S. PATENT DOCUMENTS

| | | | | | |
|---|---|---|---|---|---|
| 3,224,590 | A * | 12/1965 | Nord et al. | ..... | 210/438 |
| 4,442,003 | A * | 4/1984 | Holt | ..... | 210/445 |
| 4,555,337 | A * | 11/1985 | Gargas | ..... | 210/238 |
| 4,576,553 | A * | 3/1986 | Winston et al. | ..... | 417/9 |
| 4,635,814 | A | 1/1987 | Jones | | |
| 5,035,811 | A * | 7/1991 | Grondin et al. | ..... | 210/806 |
| 5,601,102 | A * | 2/1997 | Rivette et al. | ..... | 134/62 |
| 5,673,818 | A | 10/1997 | Kaneski et al. | | |
| 5,794,670 | A | 8/1998 | LaFleur | | |
| 5,794,818 | A | 8/1998 | Bromwell et al. | | |
| 6,086,574 | A * | 7/2000 | Carroll et al. | ..... | 604/533 |
| 6,221,145 | B1 | 4/2001 | McClain | | |
| 6,505,657 | B1 * | 1/2003 | Lawrence | ..... | 141/114 |
| 6,702,203 | B2 * | 3/2004 | Jou | ..... | 239/346 |
| 6,969,190 | B1 | 11/2005 | McClain et al. | | |
| 7,065,429 | B1 | 6/2006 | McClain et al. | | |
| 7,132,470 | B2 | 11/2006 | McClain et al. | | |
| 7,367,594 | B2 * | 5/2008 | Evans et al. | ..... | 285/247 |
| 7,698,021 | B2 * | 4/2010 | Hughes et al. | ..... | 700/285 |
| 8,056,581 | B2 * | 11/2011 | Danielson et al. | ..... | 137/614.02 |
| 2007/0235092 | A1 * | 10/2007 | Danielson et al. | ..... | 137/614 |

* cited by examiner

*Primary Examiner* — Christopher Kim
*Assistant Examiner* — Trevor E McGraw
(74) *Attorney, Agent, or Firm* — Schmeiser, Olsen & Watts LLP

(57) ABSTRACT

A nozzle includes a nozzle connector and nozzle filter engaged together. The nozzle connector is engaged with a tote connector of a tote which contains a paint component. A hose connector can be sealingly engaged with the tote connector if they are matched. The hose connector is restricted from being sealingly engaged with the nozzle connector if they do not match. Matching hose and nozzle connectors have the same color to indicate that they match each other.

8 Claims, 14 Drawing Sheets

NOZZLE FOR USE WITH A TOTE

BACKGROUND OF THE INVENTION

1. Field of the Invention

This invention relates to the filtering of a paint component stored in a tote.

2. Description of the Related Art

Paint is generally manufactured at a paint manufacturing facility and then transported in separate containers to a point of sale, wherein each container contains one type and color of paint. Different types of paint include two or more different paint components in various amounts. The type and amount of paint components included in paint determine its characteristics, such as drying time, finish, texture, etc. Different types of paint generally have different finishes. For example, some types of paint have a flat finish and others have a high-gloss finish. Consumers often desire different types of paint in different colors, so an inventory of them is maintained at the point of sale to satisfy consumer needs. However, maintaining an inventory of different types and colors of paint is a problem because it is inconvenient and costly.

One solution to this problem is provided in U.S. Pat. Nos. 6,221,145, 6,969,190, 7,065,429 and 7,132,470 to McClain, et al., which sets forth a paint manufacturing system that allows for the manufacture of paint at a point of sale. The paint is manufactured from paint components which are moved to the point of sale in totes. The paint components are removed from the totes and flowed into corresponding paint component storage containers.

However, one problem is that the paint component in the tote can settle if it is in the tote for a long period of time. A paint component settles when its components become unmixed and forms particles. Another problem is that the wrong paint component can be flowed into the wrong paint component storage container, which can degrade the quality of the paint manufactured with the paint manufacturing system.

BRIEF SUMMARY OF THE INVENTION

The present invention provides a nozzle which includes a nozzle connector and nozzle filter engaged together. The nozzle connector is engaged with a tote connector of a tote which contains a desired paint component. A hose connector can be sealingly engaged with the nozzle connector. In some embodiments, the hose connector can be sealingly engaged with the nozzle connector if they match and the hose connector is restricted from being sealingly engaged with the nozzle connector if they do not match. In this way, matching hose and nozzle connectors can be used with a predetermined type of paint component instead of different paint components, which reduces the likelihood of cross-contamination.

In some embodiments, matching hose and nozzle connectors have the same color to indicate that they match each other, wherein the color corresponds to one type of paint component. The color coding of the hose and nozzle connectors facilitates the selection of matching hose and nozzle connectors for use with the desired paint component.

These and other features, aspects, and advantages of the present invention will become better understood with reference to the following drawings and description.

DETAILED DESCRIPTION OF THE INVENTION

Figure 1:
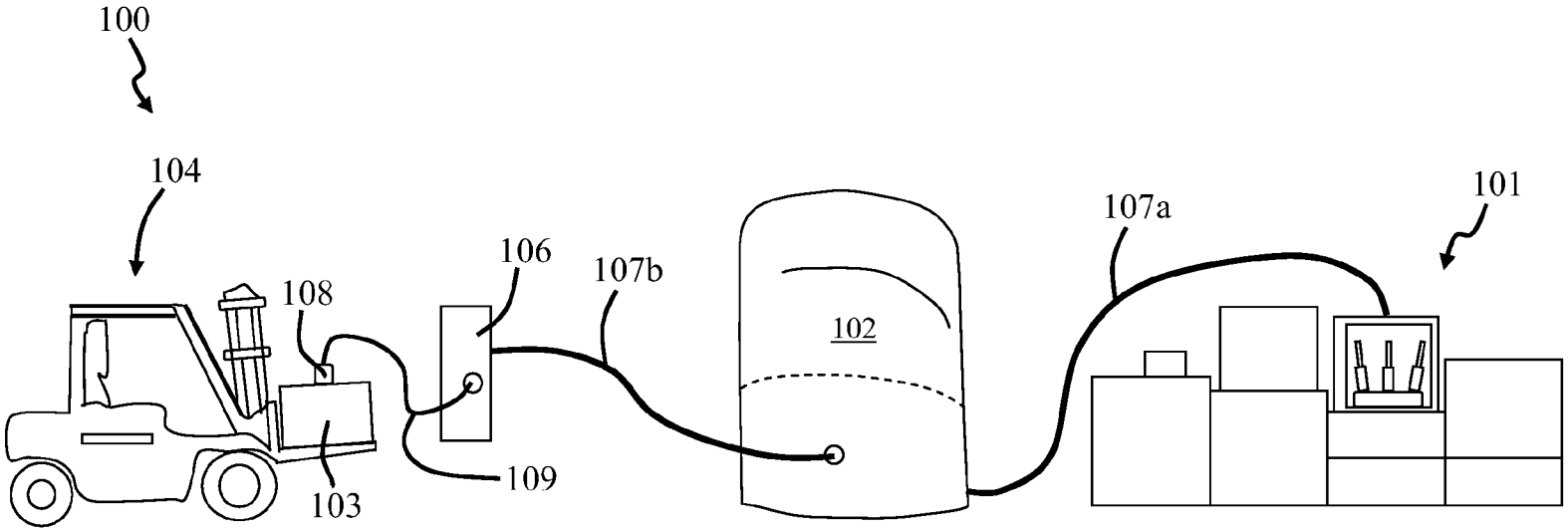
FIG. 1 is a perspective view of a paint manufacturing system having a nozzle, in accordance with the invention.

FIG. 1 is a perspective view of a paint manufacturing system 100 with a nozzle 108, in accordance with the invention. More information regarding paint manufacturing system 100 can be found in a co-pending U.S. patent application Ser. No. 11/757,264, filed on Jun. 1, 2007, by the same inventors. In this embodiment, paint manufacturing system 100 is located at a point of sale, which can be at many different locations, such as a retail store. Paint manufacturing system 100 allows the manufacture of a desired type and color of paint at the point of sale. Manufacturing the paint at the point of sale is useful for several reasons, with one being that the desired paint can be manufactured in response to the desires of a consumer. Hence, the type and color of the paint can be selected by the consumer before the paint is manufactured. This allows the paint retailer to provide an "inventory on demand", wherein an inventory of paint is produced in response to an indication that the consumer wants a particular type and color of paint. If the type and color of the paint produced is desired, the consumer is more likely to purchase it. Hence, the consumer is more likely to want paint and to purchase it if the paint is manufactured at the point of sale.

In this embodiment, paint manufacturing system 100 includes a paint component dispensing system 101 and a paint component storage container 102. Paint component storage container 102 stores a desired paint component which is flowed to paint component dispensing system 101 through a hose 107*a*. In this way, paint component dispensing system 101 and paint component storage container 102 are in fluid communication with each other. The flow of the paint component through hose 107*a* is controlled by a computer system (not shown) included with paint component dispensing system 101. As discussed in more detail in the above co-pending application, two or more paint components are dispensed by paint component dispensing system 101 to form the desired type of paint.

It should be noted that one paint component storage container is shown here for simplicity. However, in general, two or more paint component storage containers are included in paint manufacturing system 100. The number of paint component storage containers corresponds with the number of different types of paint components dispensed by paint component dispensing system 100. In one particular example, paint manufacturing system 100 includes four paint component storage containers which contain a pigment composition, dispersant thickening agent, high resin content binder and low resin content binder, respectively. In this way, paint component dispensing system 100 is capable of dispensing four or fewer different paint components to manufacture the desired type of paint.

In this embodiment, paint manufacturing system 100 includes a pumping system 106 in fluid communication with paint component storage container 102 through a hose 107*b*. The operation of pumping system 106 is controlled by the computer system included with paint component dispensing system 101. Pumping system 106 can include many different types of pumps, such as an air diaphragm pump. One type of air diaphragm pump that can be used is made by Warren Rupp and referred to as the SANDPIPER. Pumping system 106 can also include a peristaltic pump, such as that made by Watson-Marlow Bredel and referred to as the SPX32 peristaltic pump.

Pumping system 106 is in fluid communication with a paint component transport container through a hose 109 and nozzle 108. More information regarding nozzle 108 is provided in FIGS. 3*c*, 3*d*, 3*e* and 3*f*. In this embodiment, the paint component transport container is embodied as a tote 103, which is mobile so it can be transported from one location to another. Tote 103 can be of many different types, but it is generally a lined container capable of containing the desired paint component so that the desired paint component can be transported from one location to another. More information regarding totes is provided in U.S. Pat. Nos. 4,635,814, 5,673,818, 5,794,818, 5,794,670 and 6,505,657, as well as the references cited therein.

In operation, tote 103 is positioned proximate to pumping system 106. Tote 103 can be positioned in many different ways, such as by transporting it with a fork-lift 104. In this way, the desired paint component is moved to the point of sale in a tote. Pumping system 106 flows the desired paint component from tote 103, through nozzle 108 and hoses 109 and 107*b*, and into paint component storage container 102. In this way, the desired paint component is removed from one paint component storage container and flowed into another.

It is desirable to reduce the amount of particles included in the paint component as it flows between tote 103 and paint component storage container 102. In general, particles in the desired paint component degrade the quality of the paint manufactured by paint component dispensing system 101. Further, it is desirable to restrict the flow of different types of paint components into paint component storage container 102. It is desirable to restrict the flow of an undesirable paint component into the paint component storage container 102.

For example, if paint component storage container 102 is being used to contain a high resin content binder, it is desirable to flow the high resin content binder into container 102. Further, it is undesirable to flow a dispersant thickening agent, for example, into storage container 102 because this will undesirable form paint in storage container 102. Hence, it is desirable for the paint component flowed into paint component storage container 102 to consist of the desired paint component. In some embodiments, it is desirable for the paint component flowed into paint component storage container 102 to consist essentially of the desired paint component.

For example, if paint component storage container 102 is being used to contain a low resin content binder, it is desirable to flow the low resin content binder into container 102. Further, it is undesirable to flow a dispersant thickening agent or a high resin content binder, for example, into storage container 102 because this will undesirable form paint in storage container 102. Hence, it is desirable to allow the desired paint component to flow into paint component storage container 102, and to restrict the flow of undesired paint components into paint component storage container 102.

Figure 2A:
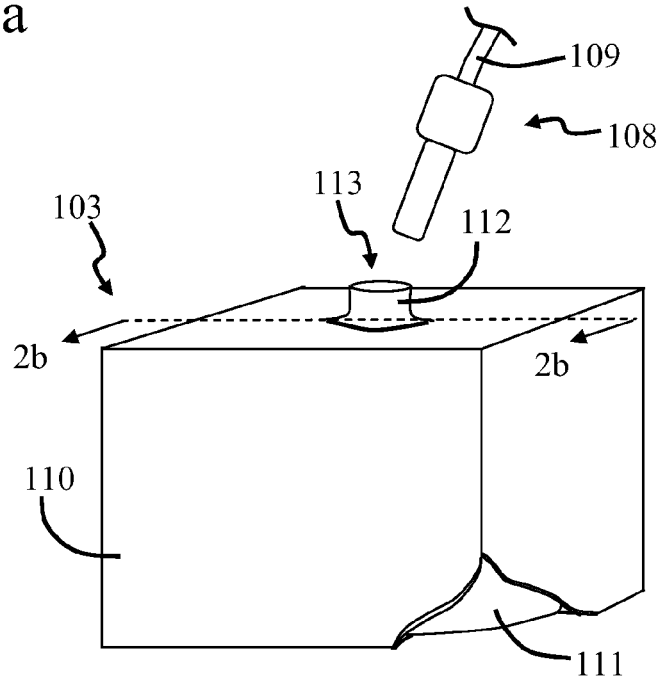
FIG. 2*a* is a more detailed perspective view of a tote with a tote connector and the nozzle included with the paint manufacturing system of FIG. 1.
Figure 2B:
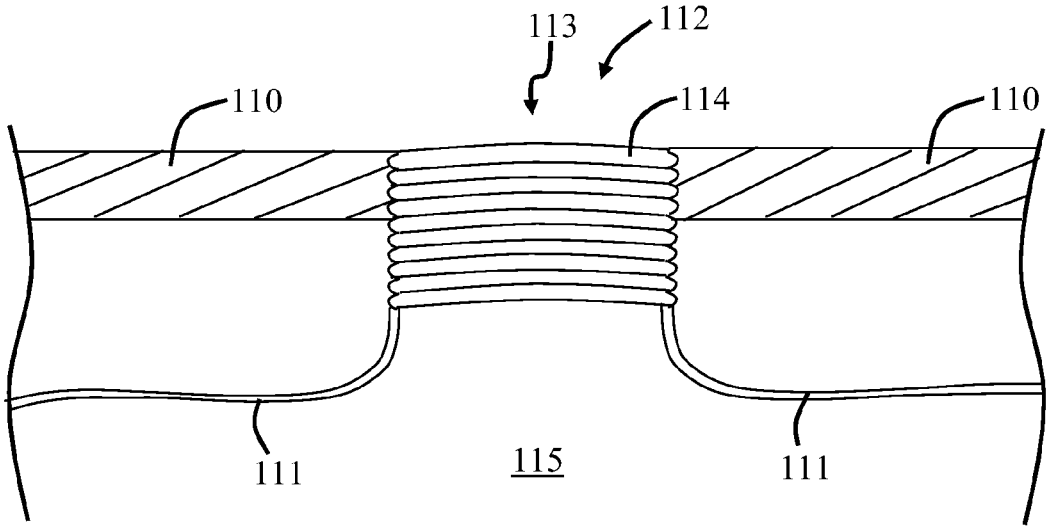
FIGS. 2*b* and 2*c* are a cut-away side view of the tote of FIG. 2*a* taken along a cut-line 2*b*-2*b*, wherein the tote connector is in stowed and deployed positions, respectively.
Figure 2C:
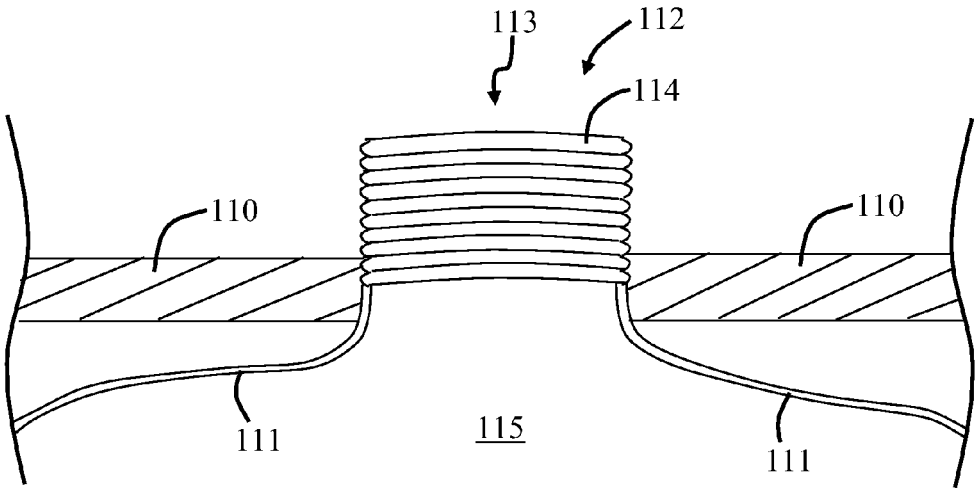

FIG. 2*a* is a more detailed perspective view of tote 103, and FIGS. 2*b* and 2*c* are cut-away side views of tote 103 taken along a cut-line 2*b*-2*b* of FIG. 2*a*, with tote connector 112 in stowed and deployed positions, respectively. In this embodiment, tote 103 includes a tote body 110 which encloses a tote bladder 111. Tote bladder 111 contains the paint component in an inner volume 115, and tote body 110 protects tote bladder 111 from being damaged. A tote connector 112 is connected to tote bladder 111 and has an opening 113 in fluid communication with inner volume 115. Opening 113 is sized and shaped to receive nozzle 108, as will be discussed in more detail with FIGS. 3*c*, 3*d*, 3*e* and 3*f*. Tote connector 112 includes inner tote connector threads 114 which extend along its inner periphery and face tote connector opening 113. In some embodiments, tote connector 112 and nozzle connector 120 are a single integral piece so that nozzle connector 120 remains with tote 103 and prevents the wrong hose connector from being in fluid communication with the paint component contained in tote 103.

It should be noted that tote 103 generally includes a tote connector cap (not shown) for connecting to tote connector 112 so it seals tote connector opening 113. The tote connector cap is used to seal opening 113 so that the paint component in inner volume 115 is sealed in tote bladder 111. However, the tote connector cap is removed from tote connector 112 when removing the paint component from tote bladder 111, so it is not shown. The paint component can be removed from tote bladder 111 in many different ways, one of which will be discussed in more detail presently.

In this embodiment, tote connector 112 is repeatably moveable between stowed and deployed positions, as shown in FIGS. 2*b* and 2*c*, respectively. Tote connector 112 is generally in the stowed position when tote 103 is being stored or moved from one location to another. Tote connector 112 is generally in the deployed position when the paint component contained in bladder 111 is being removed therefrom. Tote connector 112 can be moved between the stowed and deployed positions in many different ways, such as manually by grasping it. It should be noted that the tote cap is typically flush with tote body 110 when it is engaged with inner tote connector threads 114 and tote connector 112 is in the stowed position.

Nozzle 108 is connected to hose 109 and is repeatably moveable between positions engaging and disengaging tote connector 112, as will be discussed in more detail with FIGS. 3*a*-3*e*. In accordance with the invention, nozzle 108 filters the paint component as it flows between tote 103 and hose 109. In this way, nozzle 108 reduces the amount of particles included in the paint component as it flows between tote 103 and paint component storage container 102. Further, in some embodiments, nozzle 108 restricts the flow of different types of paint components into paint component storage container 102. Nozzle 108 can restrict the flow of different types of paint components into paint component storage container 102 in many different ways, one of which will be discussed in more detail with FIGS. 4, 5*a*, 5*b* and 5*c*.

Figure 3A:
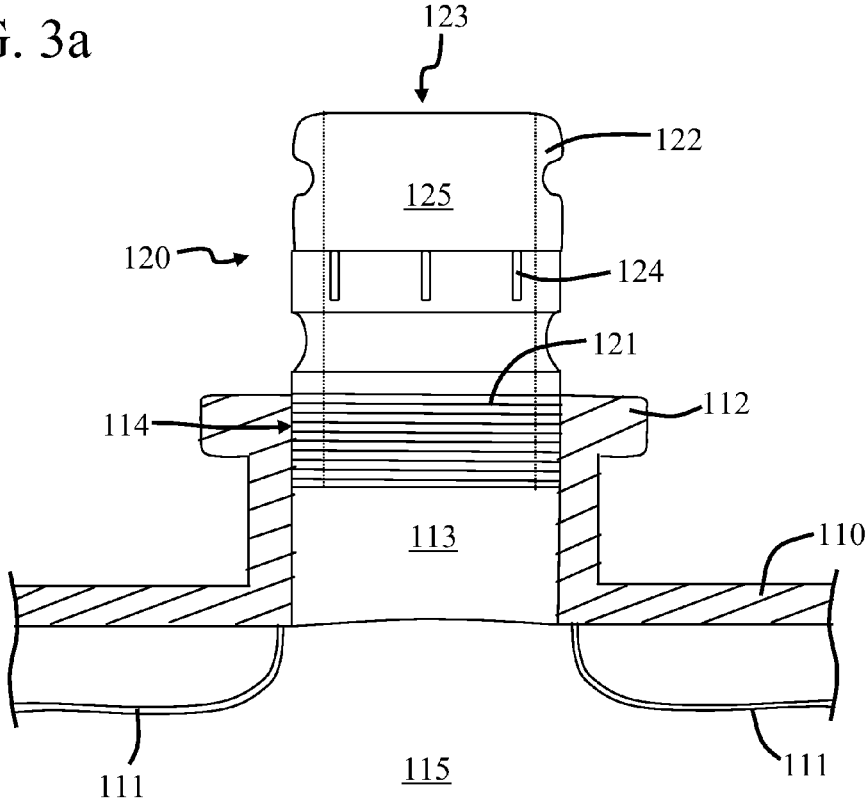
FIG. 3*a* is a side view of a nozzle connector included with the nozzle of FIGS. 1 and 2*a*.

FIG. 3*a* is a cut-away side view of a nozzle connector 120 included with nozzle 108 and engaged with tote connector 112, in accordance with the invention. In this embodiment, nozzle connector 120 includes nozzle connector threads 121 which threadingly engage tote connector threads 114. Nozzle connector 120 includes gripping members 124 which can be gripped to rotate nozzle connector 120 relative to tote connector 112. Gripping and rotating nozzle connector 120 facilitates the engagement and disengagement of nozzle connector threads 121 and tote connector threads 114. An opening 123 of nozzle connector 120 is in fluid communication with opening 113 of tote connector 112 through a channel 125 when nozzle connector 120 is engaged with tote connector 112. Nozzle connector 120 includes a hose connector seal 122 positioned proximate to opening 123. Hose connector seal 122 is for sealingly engaging a hose connector, as will be discussed in more detail with FIG. 3*d*. Opening 123 and channel 125 are sized and shaped to receive a nozzle filter, one of which will be discussed in more detail presently.

Figure 3B:
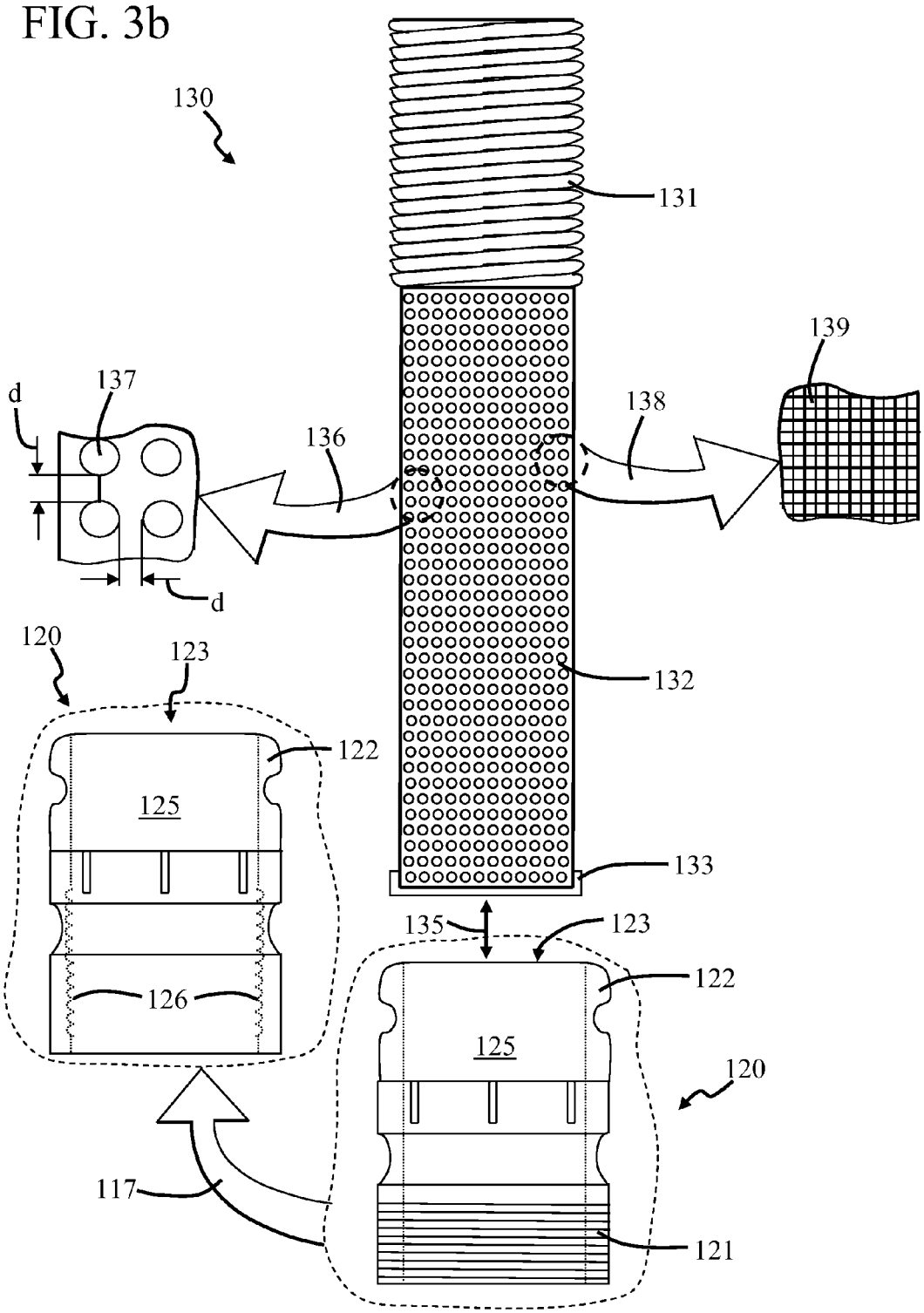
FIG. 3*b* is a side view of a nozzle filter included with the nozzle of FIGS. 1 and 2*a*.

FIG. 3*b* is a side view of a nozzle filter 130 included with nozzle 108, in accordance with the invention. In this embodiment, nozzle filter 130 includes a nozzle strainer 132 coupled to a hollow flexible extension 131. Nozzle strainer 132 and hollow flexible extension 131 can have many different shapes, but they are cylindrical in this embodiment. Hollow flexible extension 131 can be smooth in some embodiments, but here it includes outwardly facing grooves which allow it to move between flexed and unflexed conditions. Hollow flexible extension 131 is hollow so that the paint component can flow through it. Hollow flexible extension 131 allows nozzle strainer 132 to move relative to nozzle connector 120. Nozzle strainer 132 strains the paint component as it flows therethrough to restrict the flow of particles through hollow flexible extension 131. In this way, nozzle 108 filters the paint component as it flows between tote 103 and paint component storage container 102.

Nozzle strainer 132 can strain the paint component in many different ways. In this embodiment, nozzle strainer 132 includes openings 137, as indicated by an indication arrow 136. Openings 137 are sized and shaped to allow the flow of the paint component and to restrict the flow of particles included therein. Openings 137 can have many different shapes and sizes. In this embodiment, openings 137 are circular in shape and have diameters in a range between about 0.125 inches to about 0.135 inches. It should be noted, however, that openings 137 can have non-circular shapes, such as rectangular, and can have diameters outside of this range. Further, openings 137 can be spaced apart from each other by many different distances. In this embodiment, openings 137 are spaced apart from each other by a distance d, which is between about 0.125 inches to about 0.75 inches. It should be noted that openings 137 can be spaced apart from each other by distances outside of this range. Distance d, as well as the size and shape of openings 137, are generally chosen in response to the size and shape of particle it is desired to filter. Distance d, as well as the size and shape of openings 137, can also be chosen to provide a desired flow rate of the paint component therethrough.

Nozzle strainer 132 and flexible extension 132 can include many different types of materials, such as plastic, rubber and metal, among others. The metal can be of many different types, such as stainless steel. It should be noted that, in some embodiments, nozzle strainer 132 is replaced with a mesh screen 139, as indicated by a substitution arrow 138. Mesh screen 139 generally includes elongate members spaced apart from each other to form openings for straining the paint component. Mesh screen 139 can have many different shapes, but here it is cylindrical. Mesh screen 139 can include many different types of materials, such as metal and plastic.

In this embodiment, nozzle filter 130 includes a nozzle filter cap 133 carried by nozzle strainer 132. Here, nozzle filter cap 133 is attached to an end of nozzle strainer 132 opposed to hollow flexible extension 131. Nozzle filter cap 133 includes a soft and smooth material and protects tote bladder 111 from being damaged by nozzle strainer 132. Nozzle strainer 132 can damage tote bladder 111 when it extends through inner volume 115, as will be discussed in more detail with FIGS. 3*d* and 3*e*. Nozzle strainer 132 can undesirably puncture tote bladder 111 if it includes sharp corners and/or edges. However, nozzle strainer 132 is less likely to puncture tote bladder 111 if its sharp corners and edges are covered by nozzle filter cap 133. It should be noted that nozzle filter cap 133 can have many different shapes, but here it is disc shaped because nozzle strainer 132 is cylindrical and nozzle filter cap 133 is positioned on its end. Nozzle filter cap 133 is generally a solid piece of material that does not include openings, although it can include openings in some embodiments. The paint component can flow through nozzle filter cap 133 if it includes openings.

As indicated by motion arrow 135, nozzle filter 130 can be moved so it extends through nozzle connector 120. Nozzle filter 130 is repeatably moveable between engaged and disengaged positions with nozzle connector 120. Nozzle filter 130 and nozzle connector 120 can be engaged together in many different ways. In this embodiment, nozzle filter 130 extends through opening 123 and channel 125 so that nozzle filter 130 and nozzle connector 120 are engaged together. In this way, nozzle connector 120 and nozzle filter 130 are slidingly engaged together.

In another embodiment, and as indicated by a substitution arrow 117, nozzle connector 120 includes grooves 126 which face channel 125, wherein grooves 126 are shown in phantom. Grooves 126 are sized, shaped and spaced apart to engage corresponding outwardly facing grooves of hollow flexible extension 131. In this way, hollow flexible extension 131 and grooves 126 are frictionally engaged together. It should be noted that hollow flexible extension 131 can be engaged with nozzle connector 120 in many other ways. For example, an adhesive can be used to adhesively couple them together. The adhesive can be of many different types, such as glue.

Figure 3C:
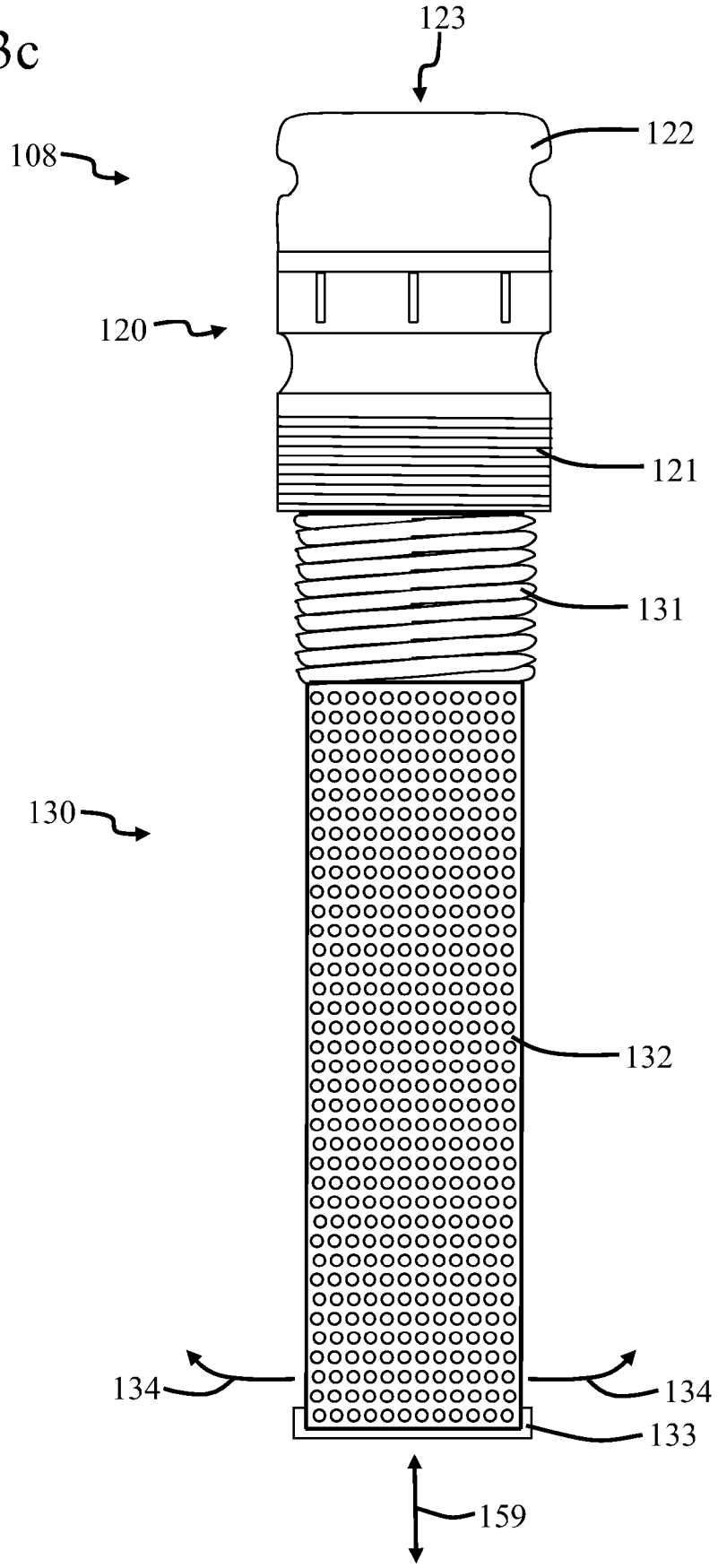
FIG. 3*c* is a side view of the nozzle connector and nozzle filter of FIGS. 3*a* and 3*b*, respectively, engaged together to form the nozzle of FIGS. 1 and 2*a*.

FIG. 3*c* is a side view of nozzle connector 120 and nozzle filter 130 engaged together to form nozzle 108 (FIGS. 1 and 2*a*). Hollow flexible extension 131 allows nozzle strainer 132 to move towards nozzle connector 120 and away from it, as indicated by a movement arrow 159. Hollow flexible extension 131 allows nozzle strainer 132 to move as indicated by movement arrow 159 because it is repeatably moveable between flexed and unflexed conditions, as discussed in more detail above. When hollow flexible extension 131 is in its flexed condition, nozzle strainer 132 is away from nozzle connector 120 and when hollow flexible extension 131 is in its unflexed condition, nozzle strainer 132 is towards nozzle connector 120. This feature is useful so that nozzle strainer 132 can move in response to the paint component flowing out of tote 103.

Further, hollow flexible extension 131 allows nozzle filter 132 to move laterally relative to nozzle connector 120, as indicated by movement arrows 134. The ability of nozzle filter 132 to move laterally relative to nozzle connector 120 makes it easier to engage nozzle 108 with tote connector 112 by inserting it through opening 123, as will be discussed in more detail presently.

Figure 3D:
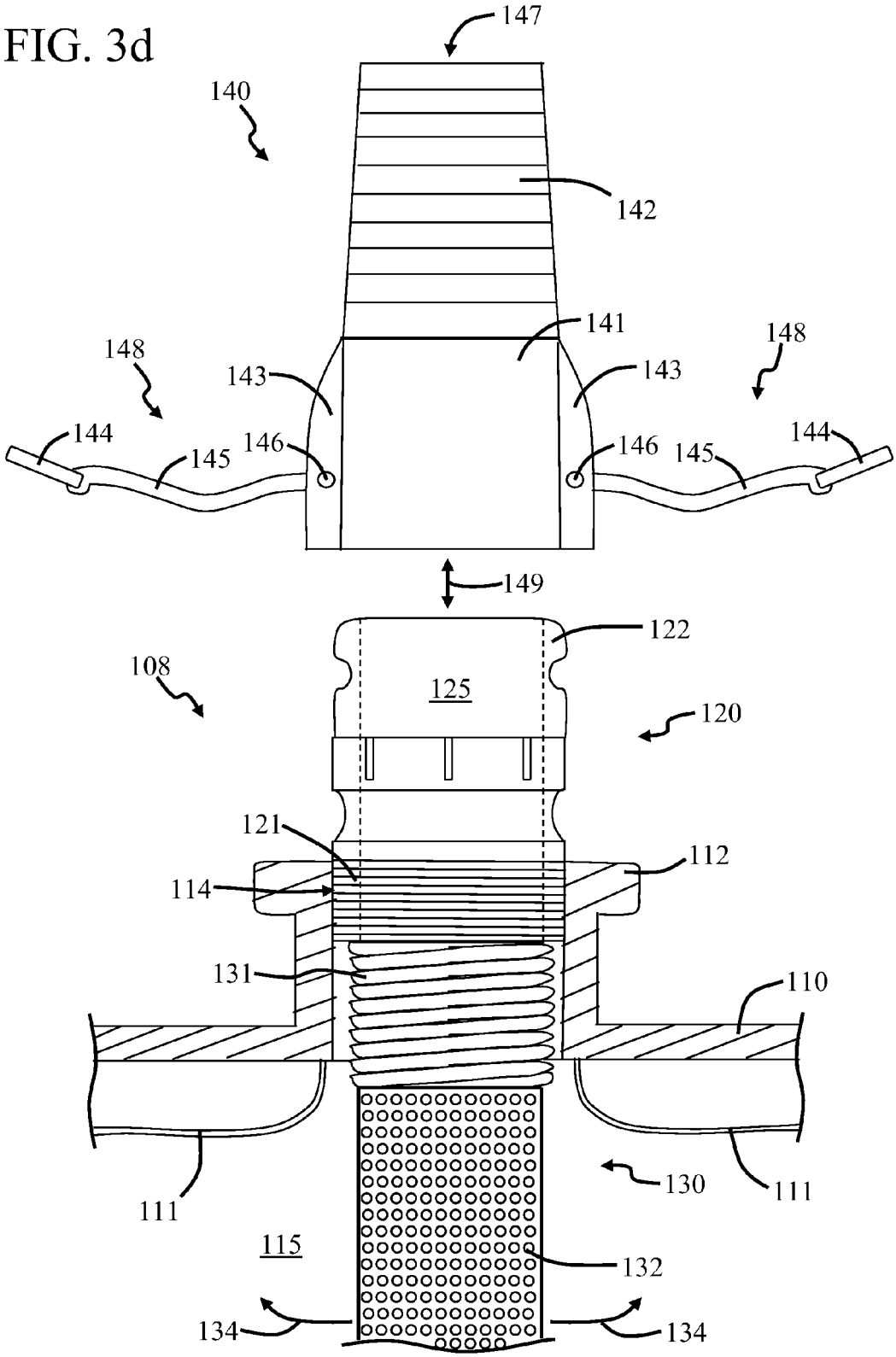
FIG. 3*d* is a side view of the nozzle of FIGS. 1 and 2*a* engaged with the tote connector of FIG. 2*a*, and a hose connector, in accordance with the invention.

FIG. 3*d* is a side view of nozzle 108 engaged with tote connector 112, in accordance with the invention. In this embodiment, nozzle 108 is engaged with tote connector 112 by threadingly engaging nozzle connector threads 121 with tote connector threads 114 so that nozzle filter 130 extends through inner volume 115.

In this embodiment, hose connector 140 includes a hose connector body 141 and a tapered body portion 142 coupled together. It should be noted that hose connector body 141 and tapered body portion 142 are generally a single integral piece of material. An opening 147 extends through hose connector body 141 and tapered body portion 142. Opening 147 is in fluid communication with channel 125 of nozzle connector 120 when hose connector 140 and nozzle 108 are engaged together.

In this embodiment, hose connector 140 is used to couple hose 109 to nozzle 108 so they are in fluid communication with each other. Hose connector 140 is repeatably moveable between engaged and disengaged positions with nozzle 108 by moving it as indicated by a movement arrow 149. Hose connector 140 can be engaged with nozzle 108 in many different ways. In this embodiment, hose connector 140 is engaged with nozzle connector 120. Hose connector 140 and nozzle connector 120 can be engaged together in many different ways. In this embodiment, hose connector 140 and nozzle connector 120 are engaged together by using opposed arm assemblies 148. Here, arm assembly 148 includes an arm 143 extending outwardly from hose connector body 141, and a pivot pin 146 extending through arm 143. A ring 144 is coupled to pivot pin 146 with a strap 145.

Figure 3E:
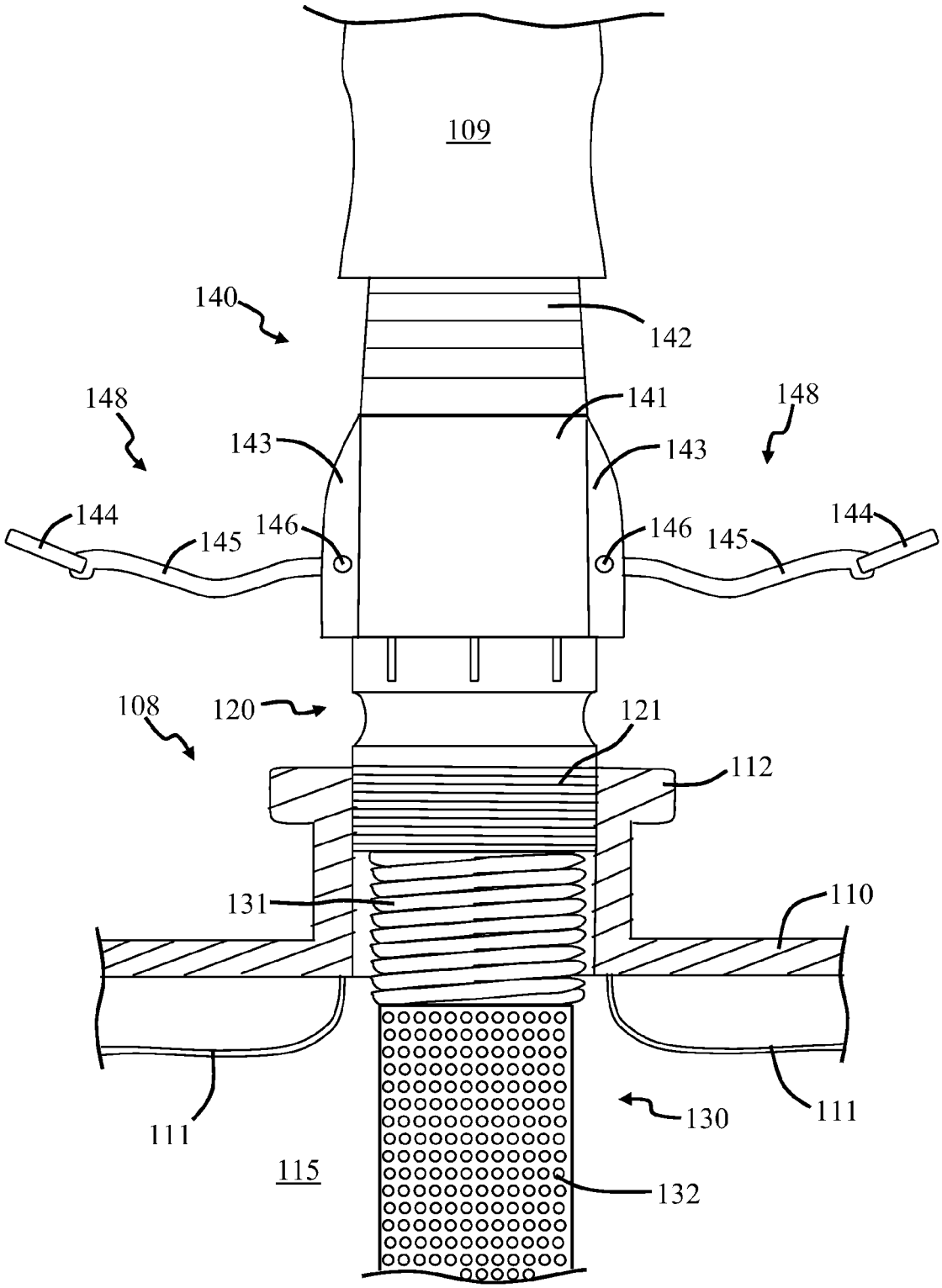
FIG. 3*e* is a side view of the nozzle of FIGS. 1 and 2*a* engaged with the tote connector of FIG. 2*a* and the hose connector of FIG. 3*d*, in accordance with the invention.

In operation, when rings 144 of opposed arm assembly 148 are grasped and pulled towards nozzle connector 120, hose connector 140 is engaged with nozzle connector 120, as shown in FIG. 3*e*. In particular, hose connector body 141 is engaged with hose connector seal 122. When rings 144 of opposed arm assembly 148 are grasped and pulled away from nozzle connector 120, hose connector 140 is disengaged from nozzle connector 120, as shown in FIG. 3*d*. In particular, hose connector body 141 is disengaged from hose connector seal 122. In this way, nozzle 108 and hose connector 140 are repeatably moveable between engaged and disengaged positions relative to each other, and hose connector 140 is used to couple hose 109 to nozzle 108 so they are in fluid communication with each other.

In this embodiment, when rings 144 of opposed arm assembly 148 are grasped and pulled towards nozzle connector 120, hose connector 140 sealingly engages nozzle connector 120. In particular, hose connector body 141 sealingly engages hose connector seal 122. When rings 144 of opposed arm assembly 148 are grasped and pulled away from nozzle connector 120, hose connector 140 is unsealed from nozzle connector 120. In particular, hose connector body 141 is unsealed from hose connector seal 122. In this way, nozzle 108 and hose connector 140 are repeatably moveable between sealed and unsealed conditions with to each other, and hose connector 140 is used to couple hose 109 to nozzle 108 so they are in fluid communication with each other.

When nozzle connector 120 and hose connector 140 are sealingly engaged together, it is less likely that the paint component will leak when it flows through them. When nozzle connector 120 and hose connector 140 are sealingly engaged together, it is less likely that the paint component will leak through the interface between hose connector seal 122 and hose connector body 141. When nozzle connector 120 and hose connector 140 are not sealingly engaged together, it is more likely that the paint component will leak when it flows through them. When nozzle connector 120 and hose connector 140 are not sealingly engaged together, it is more likely that the paint component will leak through the interface between hose connector seal 122 and hose connector body 141.

As shown in FIG. 3*e*, hose 109 is engaged with hose connector 140 by slidingly engaging it with tapered body portion 142 so it covers opening 147. In this way, hose 109 is in fluid communication with inner volume 115 of tote bladder 111 through channel 125. It should be noted that, in some embodiments, a hose clamp (not shown) is positioned to hold hose 109 to tapered body portion 142. It should also be noted that, in some embodiments, tapered body portion 142 includes threads so that hose connector 140 can be threadingly engaged with hose 109.

It should also be noted that after hose connector 140 is disengaged with nozzle 108, a cap (not shown) can be engaged with nozzle connector 120 to seal opening 123. In this way, nozzle connector 120 can remain engaged with tote connector 112 with the paint component being sealed within tote bladder 111. The cap can be of many different types, but, in this embodiment, the cap is capable of being in sealing engagement with hose connector seal 122.

Figure 4:
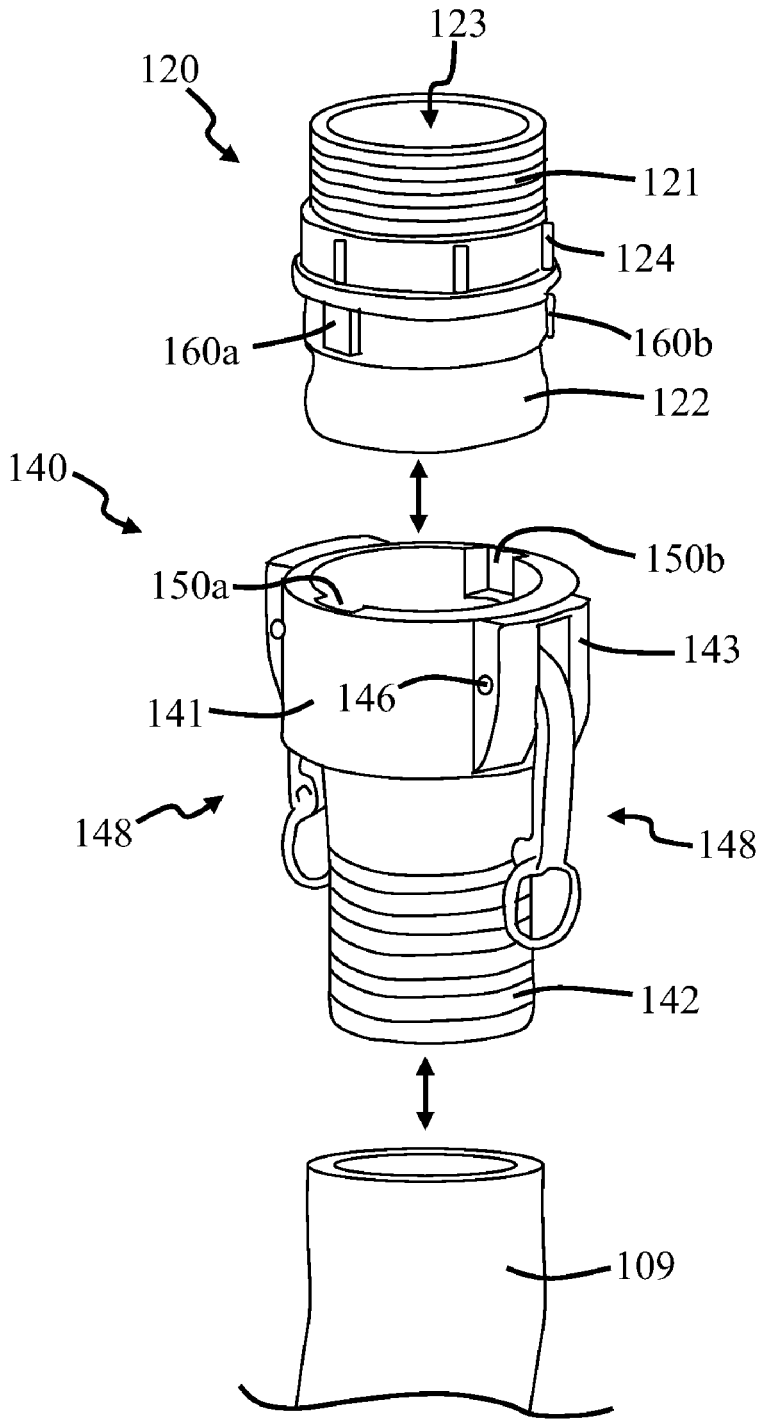
FIG. 4 is an exploded perspective view of the nozzle connector of FIG. 3*a*, hose connector of FIG. 3*d*, and the hose of FIGS. 1 and 2*a*.

FIG. 4 is an exploded perspective view of nozzle connector 120, hose connector 140 and hose 109. In this embodiment, nozzle connector 120 and hose connector 140 can be sealingly engaged together because they match each other. Further, nozzle connector 120 and hose connector 140 are restricted from being sealingly engaged together if they do not match each other. In some embodiments, nozzle connector 120 and hose connector 140 cannot be sealingly engaged together if they do not match each other. Hose connector and nozzle connector 120 can be matched with each other in many different ways.

In this embodiment, nozzle connector 120 includes opposed notches 160*a* and 160*b* and hose connector 140 includes corresponding opposed grooves 150*a* and 150*b*. Notches 160*a* and 160*b* will be discussed in more detail with FIG. 5*a* and grooves 150*a* and 150*b* will be discussed in more detail with FIG. 5*b*. Nozzle connector 120 and hose connector 140 match each other because notches 160*a* and 160*b* can be received by grooves 150*a* and 150*b*, respectively, so that they are sealingly engaged together. Nozzle connector 120 and hose connector 140 do not match each other when notches 160*a* and 160*b* cannot be received by grooves 150*a* and 150*b*, respectively. When notches 160*a* and 160*b* cannot be received by grooves 150*a* and 150*b*, respectively, nozzle connector 120 and hose connector 140 are restricted from being sealingly engaged together. It should be noted that if notches 160*a* and 160*b* do not match corresponding grooves 150*a* and 150*b*, notches 160*a* and 160*b* will engage hose connector body 141 and will not be received by corresponding grooves 150*a* and 150*b*.

Notches 160*a* and 160*b* can match corresponding grooves 150*a* and 150*b* in many different ways. The matching of notches 160*a* and 160*b* with grooves 150*a* and 150*b* will be discussed in more detail with FIGS. 5*b* and 5*c*. In this embodiment, notches 160*a* and 160*b* and grooves 150*a* and 150*b* match each other because they include matching shapes. For example, notches 160*a* and 160*b* and grooves 150*a* and 150*b* have matching shapes because they extend through rectangular volumes. In general, nozzle connector 120 and hose connector 140 can be sealingly engaged together, as shown in FIG. 3*e*, if notches 160*a* and 160*b* and grooves 150*a* and 150*b* have matching shapes. Further, nozzle connector 120 and hose connector 140 cannot be sealingly engaged together, as shown in FIG. 3*e*, if notches 160*a* and 160*b* and grooves 150*a* and 150*b* do not have matching shapes.

In this embodiment, notches 160*a* and 160*b* and grooves 150*a* and 150*b* match each other because they have matching dimensions. For example, notches 160*a* and 160*b* have dimensions chosen so that they can extend through corresponding grooves 150*a* and 150*b*. In particular, notches 160*a* and 160*b* and corresponding grooves 150*a* and 150*b* have cross-sectional dimensions chosen so that notches 160*a* and 160*b* can be received by corresponding grooves 150*a* and 150*b*. The cross-sectional dimensions of grooves 150*a* and 150*b* correspond with the dimensions of the cross-sectional area of grooves 150*a* and 150*b* as seen from a top end view of hose connector 140. Further, the cross-sectional dimensions of notches 160*a* and 160*b* correspond with the dimensions of the cross-sectional area of notches 160*a* and 160*b* as seen from a bottom end view of nozzle connector 120. It should be noted that, for simplicity, the cross-sectional dimensions of a groove and notch is referred to as its size.

In general, nozzle connector 120 and hose connector 140 can be sealingly engaged together, as shown in FIG. 3*e*, if notches 160*a* and 160*b* and grooves 150*a* and 150*b* have matching sizes. Further, nozzle connector 120 and hose connector 140 cannot be sealingly engaged together, as shown in FIG. 3*e*, if notches 160*a* and 160*b* and grooves 150*a* and 150*b* do not have matching sizes.

In this embodiment, notches 160*a* and 160*b* and grooves 150*a* and 150*b* match each other because they have matching positions. For example, notches 160*a* and 160*b* are opposed to each other and grooves 150*a* and 150*b* are opposed to each other. Hence, the positions of grooves 150*a* and 150*b* can be aligned with the positions of notches 160*a* and 160*b*. Further, the positions of grooves 150*a* and 150*b* can be aligned with the positions of notches 160*a* and 160*b*.

In general, nozzle connector 120 and hose connector 140 can be sealingly engaged together, as shown in FIG. 3*e*, if notches 160*a* and 160*b* and grooves 150*a* and 150*b* can be aligned. Further, nozzle connector 120 and hose connector 140 cannot be sealingly engaged together, as shown in FIG. 3*e*, if notches 160*a* and 160*b* and grooves 150*a* and 150*b* cannot be aligned.

In this embodiment, notches 160*a* and 160*b* and grooves 150*a* and 150*b* match each other because the number of notches matches the number of grooves. For example, nozzle connector 120 includes two notches and hose connector 140 includes two grooves. In general, nozzle connector 120 and hose connector 140 can be sealingly engaged together, as shown in FIG. 3*e*, if the number of notches equals the number of grooves. Further, nozzle connector 120 and hose connector 140 cannot be sealingly engaged together, as shown in FIG. 3*e*, if the number of notches does not equal the number of grooves.

Figure 5A:
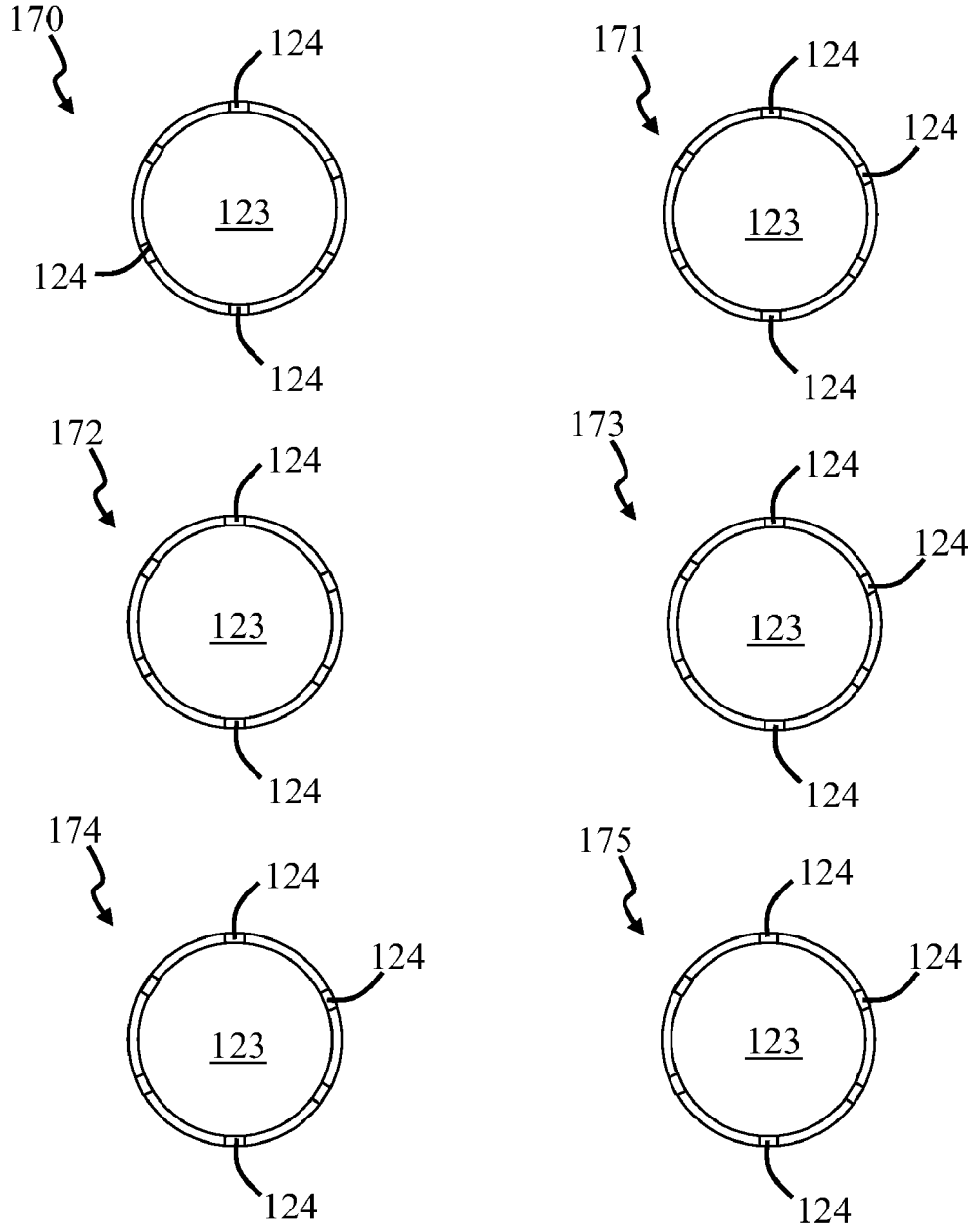
FIGS. 5*a* and 5*b* are top and bottom end views, respectively, of different embodiments of nozzle connectors, in accordance with the invention.
Figure 5B:
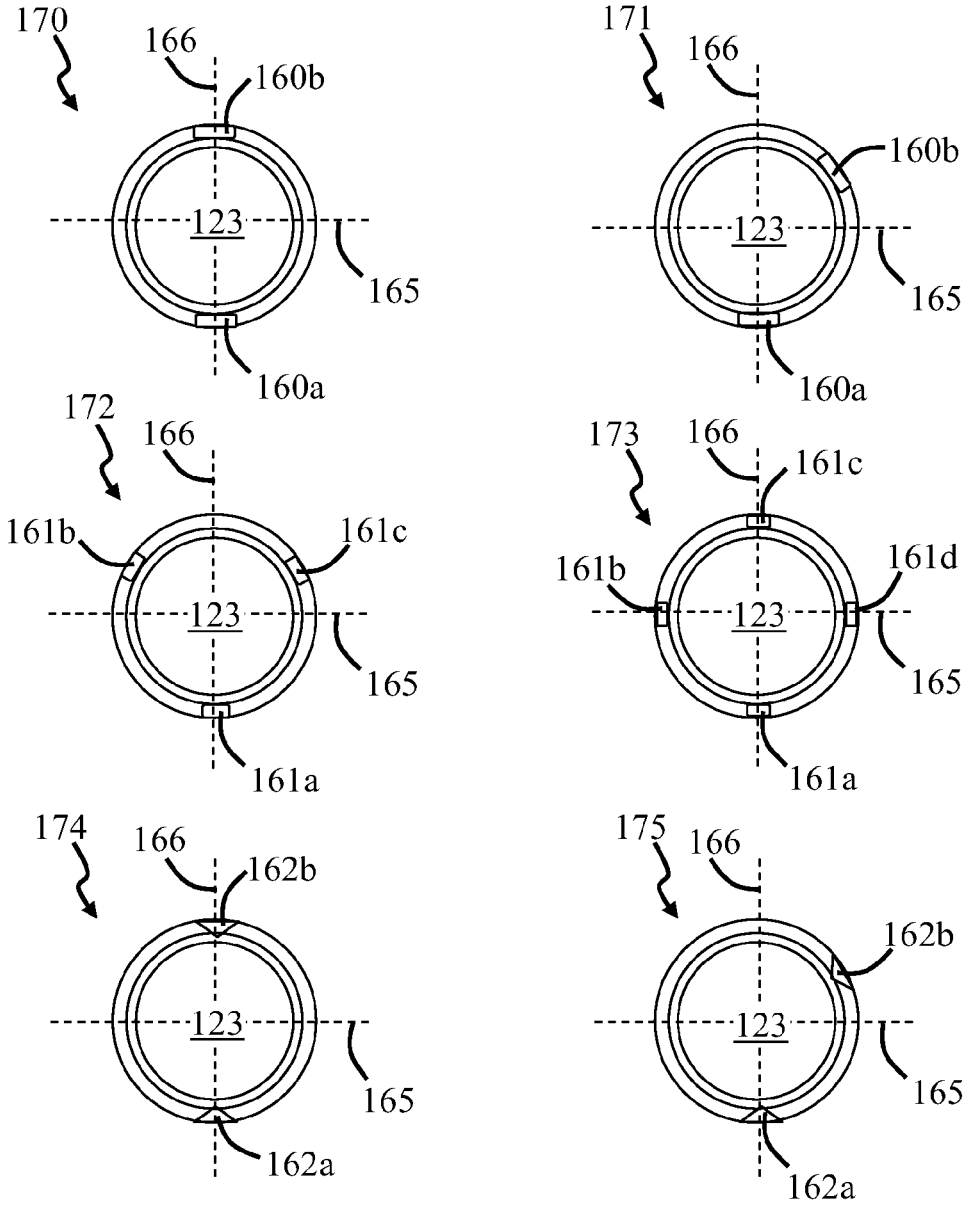

FIGS. 5*a* and 5*b* are top and bottom end views, respectively, of different embodiments of nozzle connectors, in accordance with the invention. In this embodiment, six different embodiments of nozzle connectors are shown for illustrative purposes. However, the number of nozzle connectors generally corresponds with the number of paint components dispensed by paint manufacturing system 100. For example, if paint manufacturing system 100 dispenses a pigment composition, dispersant thickening agent, high resin content binder and low resin content binder, then there are at least four nozzle connectors, with one nozzle connector being used for each paint component. In this way, the likelihood of cross-contamination is reduced.

Cross-contamination can occur when, for example, the nozzle connector for the high resin content binder is used with the pigment composition, and then used again with the high resin content binder. In this situation, it is likely that some of the pigment composition will be combined with the high resin content binder and paint will be undesirably formed.

In this embodiment, the nozzle connectors are embodied as nozzle connectors 170, 171, 172, 173, 174 and 175, wherein nozzle connectors 170, 171, 172, 173, 174 and 175 include gripping members 124, as shown in FIG. 4 and FIG. 5*a*. It should be noted that nozzle connector 170 corresponds with nozzle connector 120. It should also be noted that nozzle connectors 170, 171, 172, 173, 174 and 175 include the same number of gripping members in this embodiment, but they can include a different number of gripping members in other embodiments.

Nozzle connector 170 includes two notches 160*a* and 160*b* which are opposed to each other, as described above in more detail with FIG. 4. Opposed notches 160*a* and 160*b* of nozzle connector 170 are positioned opposite each other so that a reference line 165 extends between them and a reference line 166 extends through them. Notches 160*a* and 160*b* are spaced equidistantly apart from each other. It should be noted that reference lines 165 and 166 are perpendicular to each other for illustrative purposes.

Nozzle connector 171 also includes two notches 160*a* and 160*b*. However, notches 160*a* and 160*b* of nozzle connector 171 are not opposed to each other and notches 160*a* and 160*b* are not spaced equidistantly apart from each other. Instead, reference line 166 extends through notch 160*a* but not through notch 160*b*. Hence, nozzle connector 171 includes notches having the same dimension, shape and number as those included with nozzle connector 170. However, nozzle connector 171 includes notches having different positions relative to those included with nozzle connector 170 so that nozzle connector 171 does not match the same hose connector as nozzle connector 170.

Nozzle connector 172 includes three notches 161*a*, 161*b* and 161*c*, wherein reference line 166 extends through notch 161*a* and between notches 161*b* and 161*c*. Further, reference line 165 extends between notches 161*a* and 161*b*, as well as between notches 161*a* and 161*c*. Notches 161*b* and 161*c* are on different sides of reference line 166 and are on the same side of reference line 165. Notches 161*a*, 161*b* and 161*c* are spaced equidistantly apart from each other.

Hence, nozzle connector 172 includes a different number of notches than those included with nozzle connectors 170 and 171. Further, the notches included with nozzle connector 172 are different in size relative to the notches of nozzle connectors 170 and 171. In this way, nozzle connector 172 does not match the same hose connector as nozzle connectors 170 and 171.

Nozzle connector 173 includes four notches 161*a*, 161*b*, 161*c* and 161*d*, so that it includes a different number of notches than nozzle connectors 170, 171 and 172. In this embodiment, reference line 166 extends through opposed notches 161*a* and 162*c* and reference line 165 extends through opposed notches 161*b* and 161*d*. Notches 161*a*, 161*b*, 161*c* and 161*d* are equidistantly spaced apart from each other. The notches included with nozzle connector 173 are the same size and shape as the notches included with nozzle connector 172. Further, the notches included with nozzle connector 173 have different sizes relative to the notches included with nozzle connectors 170 and 171. However, the notches included with nozzle connector 173 are positioned differently relative to those included with nozzle connectors 170-172.

Hence, nozzle connector 173 includes a different number of notches than nozzle connectors 170 and 171. Further, the notches included with nozzle connector 173 are different in size and position relative to the notches of nozzle connectors 170 and 171. In this way, nozzle connector 173 does not match the same hose connector as nozzle connectors 170 and 171. Further, nozzle connector 173 includes a different number of notches than nozzle connector 172, and these notches have different positions relative to the notches of nozzle connector 172. In this way, nozzle connector 173 does not match the same hose connector as nozzle connector 172.

Nozzle connector 174 includes two notches 162*a* and 162*b* which are opposed to each other, as described above in more detail with FIG. 4. Opposed notches 162*a* and 162*b* of nozzle connector 174 are positioned opposite each other so that a reference line 165 extends between them and a reference line 166 extends through them. Notches 162*a* and 162*b* are spaced equidistantly apart from each other.

Nozzle connector 174 includes two notches 162*a* and 162*b* so that it includes the same number of notches as nozzle connectors 170 and 171, but fewer notches than nozzle connectors 172 and 173. However, notches 162*a* and 162*b* have different shapes than the notches included with nozzle connectors 170, 171, 172 and 173. In this way, nozzle connector 174 does not match the same hose connector as nozzle connectors 170, 171, 172 and 173.

Nozzle connector 175 also includes two notches 162*a* and 162*b*. However, notches 162*a* and 162*b* of nozzle connector 175 are not opposed to each other and notches 162*a* and 162*b* are not spaced equidistantly apart from each other. Instead, reference line 166 extends through notch 162*a* but not through notch 162*b*. Hence, nozzle connector 175 includes notches having the same dimension, shape and number as those included with nozzle connector 174. However, nozzle connector 175 includes notches having different positions relative to those included with nozzle connector 174 so that nozzle connector 175 does not match the same hose connector as nozzle connector 174.

Nozzle connector 175 includes the same number of notches as nozzle connectors 170 and 171, but fewer notches than nozzle connectors 172 and 173. However, notches 162*a* and 162*b* have different shapes than the notches included with nozzle connectors 170, 171, 172 and 173. In this way, nozzle connector 175 does not match the same hose connector as nozzle connectors 170, 171, 172 and 173.

Figure 5C:
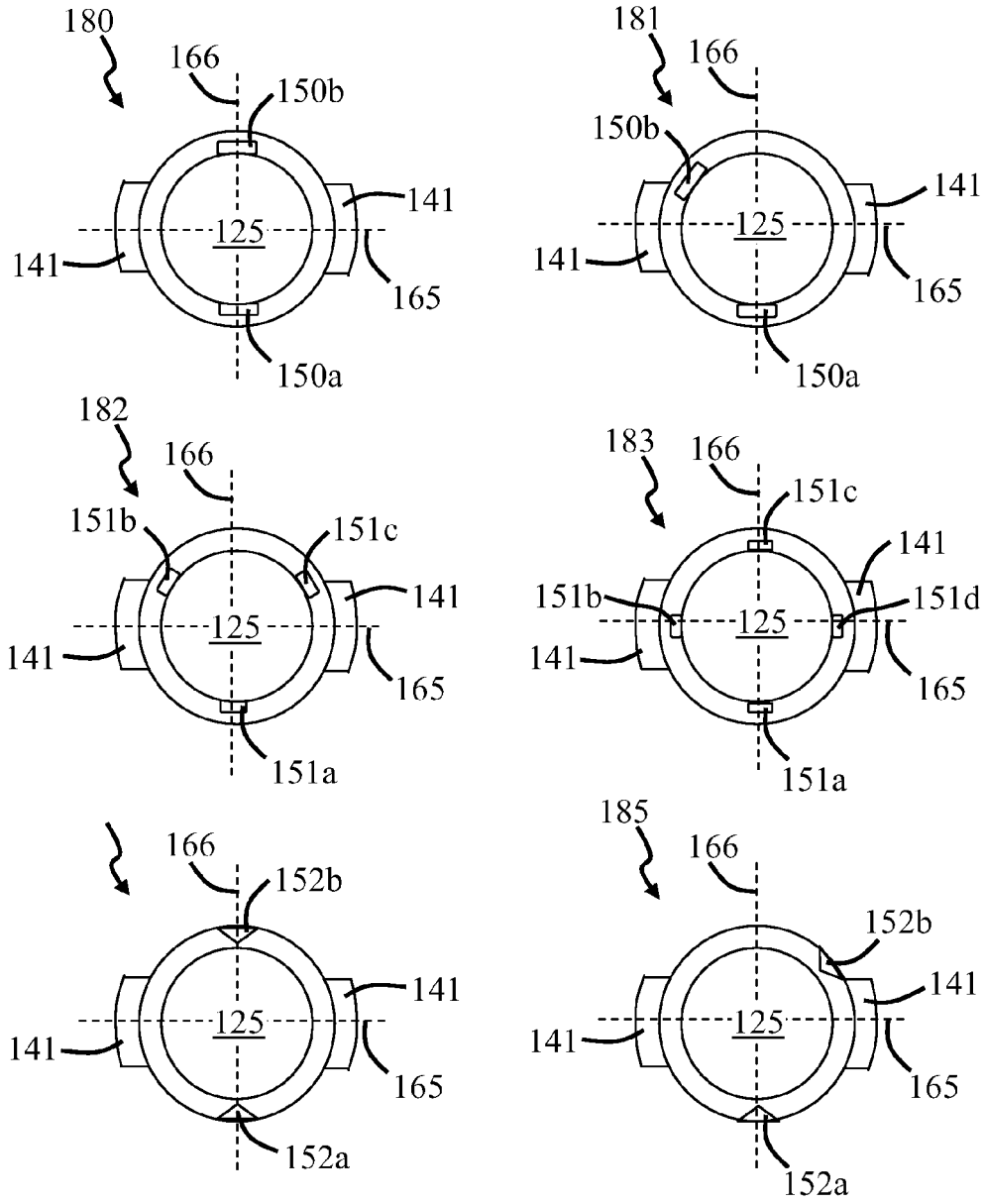
FIG. 5*c* is a top end view of different embodiments of hose connectors, in accordance with the invention.

FIG. 5*c* is a top end view of different embodiments of hose connectors, in accordance with the invention. In this embodiment, six hose connectors are shown and each hose connector is designed to match a separate nozzle connector, such as the nozzle connectors discussed above with FIGS. 5*a* and 5*b*. The hose connectors are embodied as hose connectors 180, 181, 182, 183, 184 and 185 and they match nozzle connectors 170, 171, 172, 173, 174 and 175, respectively. It should be noted that hose connector 180 corresponds with hose connector 140, as shown in FIGS. 3*d*, 3*e* and 4.

Hose connector 180 includes two grooves 150*a* and 150*b* which are opposed to each other, as described above in more detail with FIG. 4. Opposed grooves 150*a* and 150*b* of nozzle connector 180 are positioned opposite each other so that reference line 165 extends between them and reference line 166 extends through them. Hence, grooves 150*a* and 150*b* are spaced equidistantly apart from each other.

Hose connector 181 also includes two grooves 150*a* and 150*b*. However, grooves 150*a* and 150*b* of hose connector 181 are not opposed to each other and grooves 150*a* and 150*b* are not spaced equidistantly apart from each other. Instead, reference line 166 extends through groove 150*a* but not through groove 150*b*. Hence, hose connector 181 includes grooves having different positions than those included with hose connector 180 so that hose connector 181 does not match the same nozzle connector as hose connector 180.

Hose connector 182 includes three grooves 151*a*, 151*b* and 151*c*, wherein reference line 166 extends through groove 151*a* and between grooves 151*b* and 151*c*. Further, reference line 165 extends between grooves 151*a* and 151*b*, as well as between grooves 151*a* and 151*c*. Grooves 151*b* and 151*c* are on different sides of reference line 166 and are on the same side of reference line 165. Grooves 151*a*, 151*b* and 151*c* are spaced equidistantly apart from each other. Grooves 151*a*, 151*b* and 151*c* have the same shape as grooves 150*a* and 150*b*, but they have a smaller dimension. Hence, hose connector 182 includes grooves having different sizes and positions relative to those included with hose connectors 180 and 181 so that hose connector 182 does not match the same nozzle connector as hose connectors 180 and 181.

Hose connector 183 includes four grooves 151*a*, 151*b*, 151*c* and 151*d*, so that it includes more grooves than nozzle connectors 180, 181 and 182. In this embodiment, reference line 165 extends through opposed grooves 152*b* and 152*d* and reference line 166 extends through opposed grooves 152*a* and 152*c*. Grooves 151*a*, 151*b*, 151*c* and 151*d* are equidistantly spaced apart from each other. The grooves included with hose connector 183 are the same size and shape as the grooves included with hose connector 182. Further, the grooves included with hose connector 183 have different sizes relative to the grooves included with nozzle connectors 180 and 181. However, the grooves included with hose connector 183 are positioned differently relative to those included with hose connectors 180, 181 and 182.

Hence, hose connector 183 includes a different number of grooves than those included with hose connectors 180 and 181. Further, the grooves included with hose connector 183 are different in size and position relative to the grooves of hose connectors 180 and 181. In this way, hose connector 183 does not match the same hose connector as hose connectors 180 and 181. Further, hose connector 183 includes a different number of grooves than hose connector 182, and these grooves have different positions relative to the grooves of hose connector 182. In this way, hose connector 183 does not match the same nozzle connector as hose connector 182.

Hose connector 184 includes two grooves 152*a* and 152*b* so that it includes the same number of grooves as hose connectors 180 and 181, but fewer grooves than hose connectors 182 and 183. However, grooves 152*a* and 152*b* have different shapes than the grooves included with hose connectors 180, 181, 182 and 183. In this way, hose connector 184 does not match the same nozzle connector as hose connectors 180, 181, 182 and 183.

Hose connector 185 also includes two grooves 152*a* and 152*b*. However, grooves 152*a* and 152*b* of hose connector 185 are not opposed to each other and grooves 152*a* and 152*b* are not spaced equidistantly apart from each other. Instead, reference line 166 extends through groove 152*a* but not through groove 152*b*. Hence, hose connector 185 includes grooves having the same dimension, shape and number as those included with hose connector 184. However, hose connector 185 includes grooves having different positions relative to those included with hose connector 184 so that hose connector 185 does not match the same nozzle connector as hose connector 184.

Hose connector 185 includes the same number of grooves as hose connectors 180 and 181, but fewer grooves than hose connectors 182 and 183. However, grooves 152*a* and 152*b* have different shapes than the grooves included with hose connectors 180, 181, 182 and 183. In this way, hose connector 185 does not match the same nozzle connector as hose connectors 180, 181, 182 and 183.

In some embodiments, nozzle connectors 170, 171, 172, 173, 174 and 175 are provided with different colors, wherein the color is chosen to correspond with one type of paint component. Further, hose connectors 180, 181, 182, 183, 184 and 185 are provided with colors that match the colors of nozzle connectors 170, 171, 172, 173, 174 and 175. Hence, nozzle connector 170 and hose connector 180 have matching colors, nozzle connector 171 and hose connector 181 have matching colors, nozzle connector 172 and hose connector 182 have matching colors, nozzle connector 173 and hose connector 183 have matching colors, nozzle connector 174 and hose connector 184 have matching colors and nozzle connector 175 and hose connector 185 have matching colors. In this way, a hose connector can be chosen in response to a visual indication of its color to match a nozzle connector.

This color coding feature facilitates the selection of hose and nozzle containers from a plurality of hose and nozzle containers, which saves time. Further, this color coding scheme reduces the likelihood of choosing the wrong hose and nozzle containers for a type of paint component, which reduces the likelihood of cross-contamination.

Figure 6B:
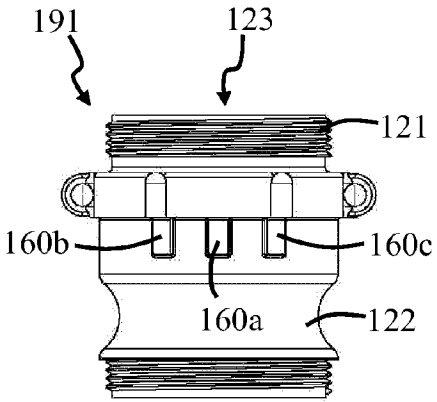
FIGS. 6*a* and 6*b* are side views of different embodiments of hose and nozzle connectors, respectively, in accordance with the invention.
Figure 6D:
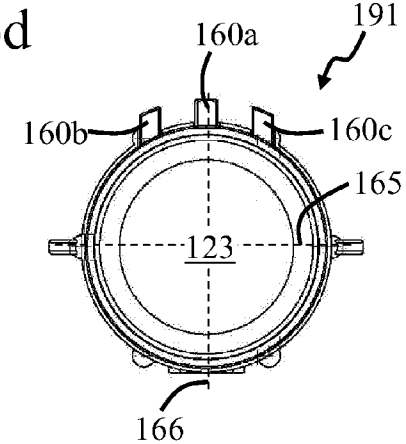
FIGS. 6*c* and 6*d* are top and bottom end views, respectively, of the hose and nozzle connectors of FIGS. 6*a* and 6*b*, respectively.
Figure 6A:
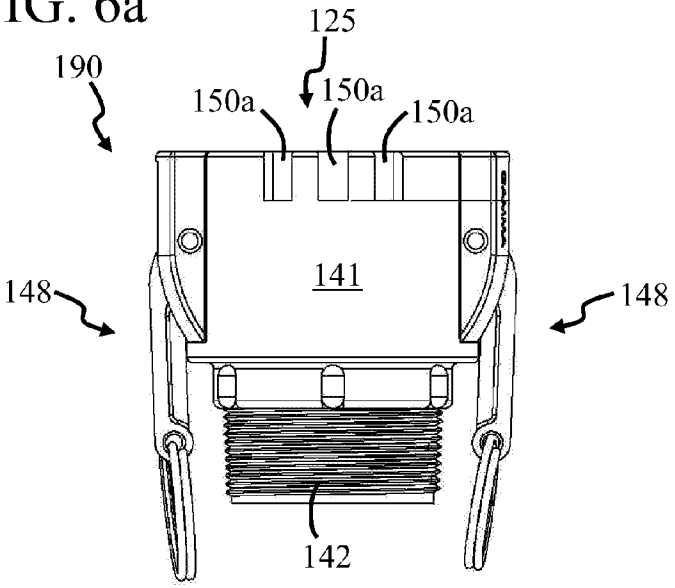
Figure 6C:
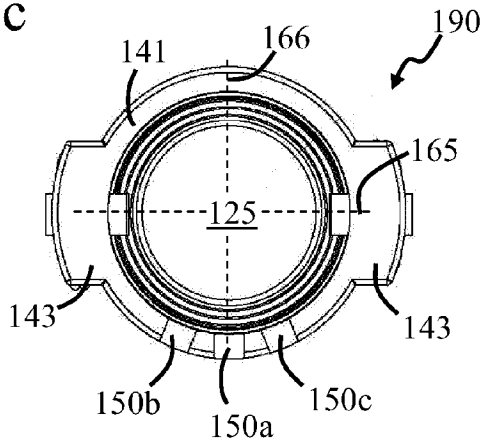

FIGS. 6*a* and 6*b* are side views of different embodiments of hose and nozzle connectors 190 and 191, respectively, in accordance with the invention, and FIGS. 6*c* and 6*d* are corresponding top and bottom views. In this embodiment, hose connector 190 includes grooves 150*a*, 150*b* and 150*c* and nozzle connector 191 includes notches 160*a*, 160*b* and 160*c*. Hose connector 190 also includes opposed arm assemblies 148. It should be noted that, in other embodiments, hose connector 190 includes notches 160*a*, 160*b* and 160*c* and nozzle connector 191 includes grooves 150*a*, 150*b* and 150*c*.

Grooves 150*a*, 150*b* and 150*c* are positioned on the same side of reference line 165. Further, reference line 166 extends through groove 150*a* and grooves 150*b* and 150*c* are positioned on different sides of reference line 166. Notches 160*a*, 160*b* and 160*c* are positioned on the same side of reference line 165. Further, reference line 166 extends through notch 160*a* and notches 160*b* and 160*c* are positioned on different sides of reference line 166.

Hose connector 190 and nozzle connector 191 are matched with each other so that they can be sealingly engaged together. In this embodiment, hose connector 190 is sealingly engaged with nozzle connector by moving notches 160*a*, 160*b* and 160*c* so they are received by grooves 150*a*, 150*b* and 150*c*, respectively.

Figure 7A:
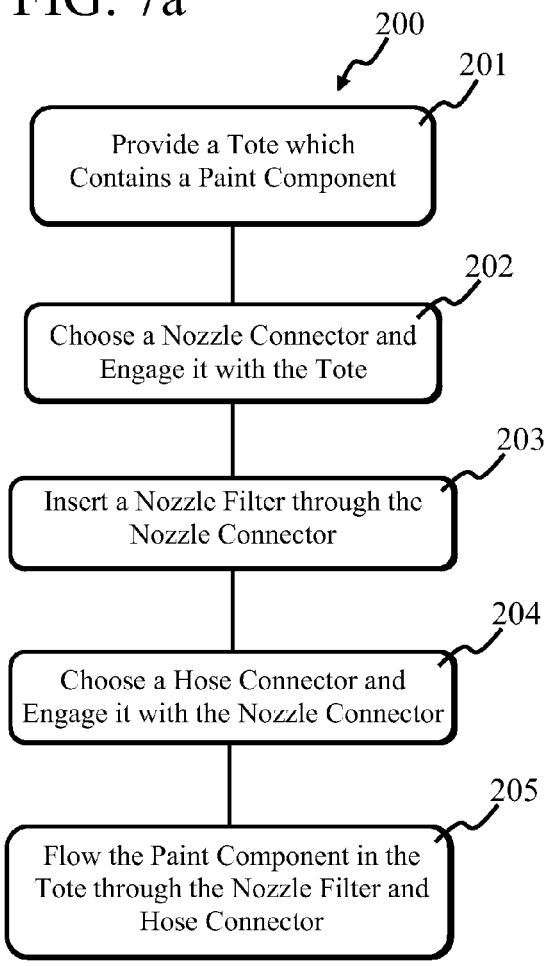
FIG. 7*a* is a flow diagram of a method of removing a paint component from a tote, in accordance with the invention.

FIG. 7*a* is a flow diagram of a method 200 of removing a paint component from a tote, in accordance with the invention. It should be noted that some of the steps and features of method 200 can be used in methods 210, 220 and 230 of FIGS. 7*b*, 7*c* and 7*d*, respectively. Further, in accordance with the invention, methods 200, 210, 220 and 230 are performed at the point of sale, although they can be performed at other locations, if desired.

In this embodiment, method 200 includes a step 201 of providing a tote which contains a paint component. The paint component can be of many different types, such as those mentioned in more detail above. The tote can be provided in many different ways, but it is generally provided by moving it to the point of sale.

Method 200 includes a step 202 of choosing a nozzle connector and engaging it with a tote connector of the tote. The nozzle connector is generally chosen in response to the type of paint component contained in the tote. It is generally desirable to use different nozzle connectors for different paint components to reduce the likelihood of cross-contamination. In some embodiments, the nozzle connectors are color coded to correspond with a particular paint component. In this way, the nozzle connector for a particular paint component can be selected in response to its color. This reduces the likelihood that the wrong nozzle connector will be chosen and used with the wrong paint component.

In this embodiment, method 200 includes a step 203 of inserting a nozzle filter through the nozzle connector. The nozzle filter can be of many different types, but it filters the paint component as it flows therethrough. In this way, particles are removed from the paint component.

In this embodiment, method 200 includes a step 204 of choosing a hose connector and engaging it with the nozzle connector. The hose connector is generally determined in response to the type of paint component contained in the tote. It is generally desirable to use different hose connectors for different paint components to reduce the likelihood of cross-contamination. In some embodiments, the hose connectors are color coded to correspond with a particular paint component. In this way, the hose connector for a particular paint component can be selected in response to its color. This reduces the likelihood that the wrong hose connector will be chosen and used with the wrong paint component.

In accordance with the invention, the nozzle and hose connectors for use with the same paint component are matched to each other and the nozzle and hose connectors for use with different paint components are not matched to each other. In this way, the nozzle and hose connectors for one paint component cannot be used with the nozzle and hose connectors for another paint component.

The nozzle and hose connectors can be matched in many different ways. In one embodiment, the nozzle and hose connectors include notches and grooves that allow them to be sealingly engaged together if the notches and grooves match each other. Further, the nozzle and hose connectors include notches and grooves that do not allow them to be sealingly engaged together if the notches and grooves do not match each other.

In this embodiment, method 200 includes a step 205 of flowing the paint component in the tote through the nozzle filter and hose connector. The paint component is generally flowed to a paint component storage container and the paint component storage container is in fluid communication with a paint component dispensing system.

Figure 7B:
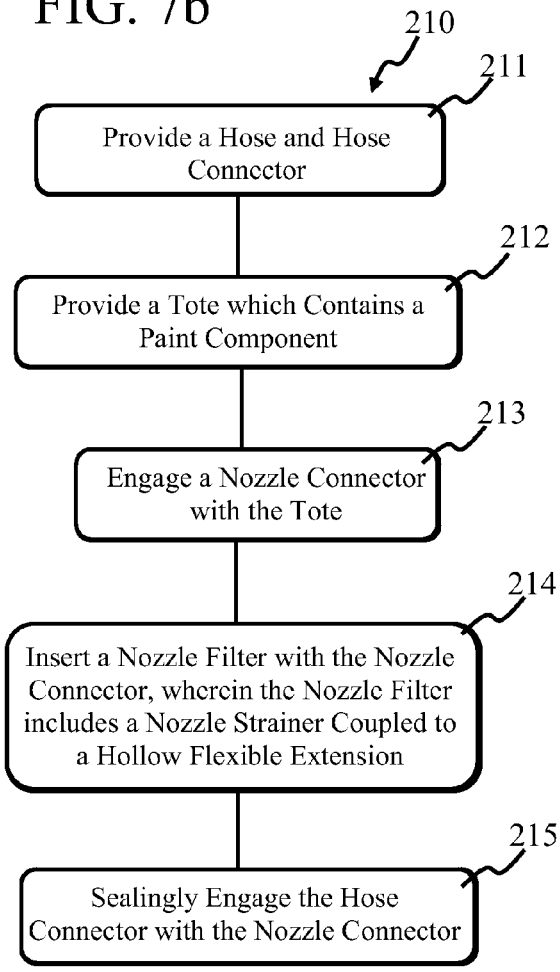
FIG. 7*b* is a method of connecting a hose to a tote, in accordance with the invention.

FIG. 7*b* is a method 210 of connecting a hose to a tote, in accordance with the invention. In this embodiment, method 210 includes a step 211 of providing a hose connected to a hose connector, wherein the hose connector is in fluid communication with a paint component storage container.

In this embodiment, method 210 includes a step 212 of providing a tote which contains a paint component, wherein it is desirable to move the paint component, through the hose and hose connector, to the paint component storage container. In this embodiment, method 210 includes a step 213 of engaging a nozzle connector with a tote connector of the tote.

In this embodiment, method 210 includes a step 214 of inserting a nozzle filter with the nozzle connector, wherein the nozzle filter includes a nozzle strainer coupled to a hollow flexible extension.

In this embodiment, method 210 includes a step 215 of sealingly engaging the hose connector with the nozzle connector. In accordance with the invention, the hose connector and nozzle connector can be sealingly engaged together if they match. Further, the hose connector and nozzle connector cannot be sealingly engaged together if they do not match.

Figure 7C:
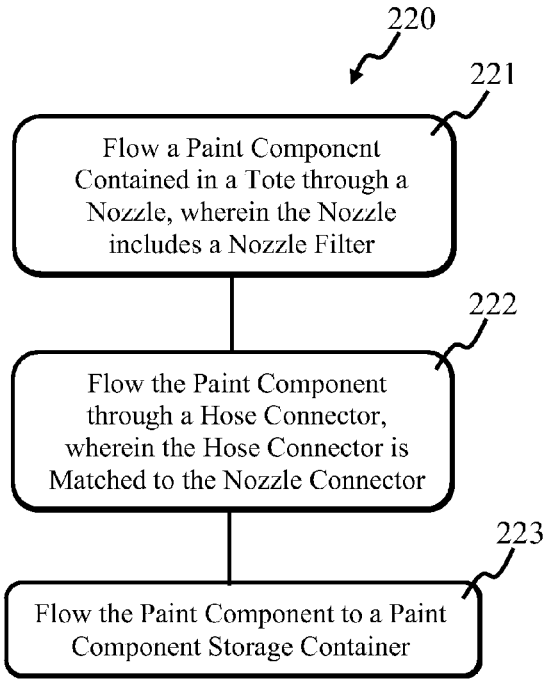
FIG. 7*c* is a method of filtering a paint component, in accordance with the invention.

FIG. 7*c* is a method 220 of filtering a paint component, in accordance with the invention. In this embodiment, method 220 includes a step 221 of flowing a paint component contained in a tote through a nozzle, wherein the nozzle includes a nozzle filter which filters the paint component as it flows therethrough. The nozzle filter can filter the paint component in many different ways, such as by straining particles from it.

In this embodiment, method 220 includes a step 222 of flowing the paint component through a hose connector, wherein the hose connector is matched to the nozzle connector. The hose connector is matched to the nozzle connector so they can be sealingly engaged together. The hose connector and nozzle connector are not matched if they cannot be sealingly engaged together.

In this embodiment, method 220 includes a step 223 of flowing the paint component to a paint component storage container. The hose connector is in fluid communication with the paint component storage container with a hose and the paint component storage container is in fluid communication with a paint dispensing system. The paint dispensing system includes a computer system which determines the amount of paint component to be dispensed by the paint dispensing system from the paint component storage container.

Figure 7D:
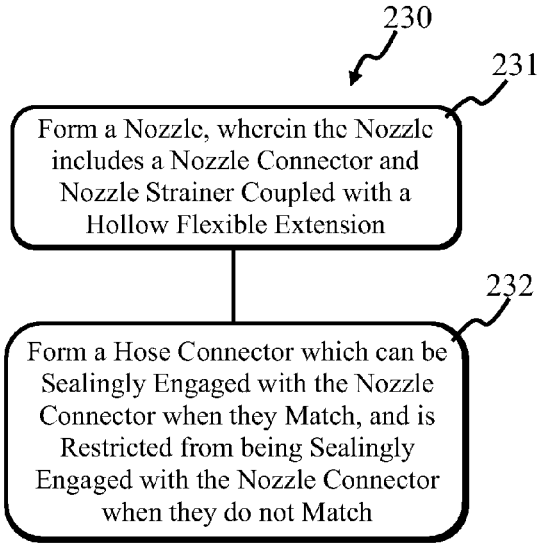
FIG. 7*d* is a method of manufacturing a nozzle, in accordance with the invention.

FIG. 7*d* is a method 230 of manufacturing a nozzle, in accordance with the invention. In this embodiment, method 230 includes a step 231 of forming a nozzle, wherein the nozzle includes a nozzle connector and a nozzle strainer coupled with a hollow flexible extension. Method 230 includes a step 232 of forming a hose connector which can be sealingly engaged with the nozzle connector when they match, and is restricted from being sealingly engaged with the nozzle connector when they do not match. In some embodiments, the nozzle connector is formed to have a desired color. In some embodiments, the hose connector is formed to have a color which matches the color of the nozzle connector. The desired color is chosen to correspond to a type of paint component.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A method of removing paint component from a tote, comprising:

providing a hose;

providing a tote which contains a paint component;

connecting said hose to said tote;

choosing a nozzle connector from a set of nozzle connectors corresponding to a number of paint component storage containers and engaging it with a tote connector, wherein each of the nozzle connectors in the set of nozzle connectors includes notches and wherein the notches are in a different position in each of the nozzle connectors in the set of nozzle connectors;

inserting a nozzle filter through the nozzle connector wherein the nozzle filter and the nozzle connector are engaged together; and choosing a hose connector from a set of hose connectors corresponding to the number of paint component storage containers and engaging it with the nozzle connector, said nozzle connector having gripping members capable of being gripped to rotate the nozzle connector relative to the tote connector and facilitate the engagement and disengagement of nozzle connector threads and tote connector threads, and a hose connector seal positioned proximate an opening of the tote connector, wherein an opening of the nozzle connector is in fluid communication with the opening of the tote connector, wherein the step of choosing the hose connector includes choosing the hose connector that matches the nozzle connector, wherein each of the nozzle connectors does not match the same hose connector.

2. The method of claim 1, wherein the step of engaging the hose and the nozzle connectors together includes moving the notch into a matching groove.

3. The method of claim 1, wherein the hose connector and nozzle connector can be sealingly engaged together if they match each other.

4. The method of claim 1, wherein the hose connector and nozzle connector are restricted from being sealingly engaged together if they do not match each other.

5. The method of claim 1, wherein each of the nozzle connectors in the set of nozzle connectors have a different color and each of the hose connectors in the set of hose connectors have a different color and further wherein the step of choosing the hose connector includes choosing the hose connector with the same color as the nozzle connector.

6. The method of claim 1, further including flowing the paint component to a paint component storage container.

7. The method of claim 1, wherein each of the nozzle connectors in the set of the nozzle connectors includes a different number of the notches.

8. The method of claim 1, wherein the notches are a different size in each of the nozzle connectors in the set of nozzle connectors.

* * * * *